United States Patent [19]

Wykhuis et al.

[11] 4,355,946

[45] Oct. 26, 1982

[54] LIFT ARM AND CONTROL LINKAGE STRUCTURE FOR LOADER BUCKETS

[75] Inventors: Lloyd A. Wykhuis; Michael J. O'Neill, both of Mayville, Wis.

[73] Assignee: Deere & Company, Moline, Ill.

[21] Appl. No.: 191,392

[22] Filed: Sep. 29, 1980

[51] Int. Cl.[3] ..... B66F 9/00

[52] U.S. Cl. ..... 414/707

[58] Field of Search ..... 414/700, 706, 707, 710, 414/714

[56] References Cited

U.S. PATENT DOCUMENTS

| | | | |
|---|---|---|---|
| 2,455,474 | 12/1948 | Drott et al. | 414/707 |
| 2,774,496 | 12/1956 | Dorkins | 414/707 |
| 3,175,711 | 3/1965 | Granryd | 414/707 |
| 3,215,292 | 2/1965 | Halls | 414/707 |
| 3,237,795 | 3/1966 | Kromer | 414/707 |

*Primary Examiner*—Trygve M. Blix
*Assistant Examiner*—Jesus D. Sotelo

[57] ABSTRACT

A skid steer loader includes lift arms which are supported by two pairs of guide links arranged such that the bucket undergoes substantially vertical movement as it moves between lowered and raised positions. One of the pairs of guide links serves as part of a self-levelling linkage which maintains the bucket in a substantially level attitude throughout the movement of the bucket between the lowered and raised positions thereof.

2 Claims, 2 Drawing Figures

LIFT ARM AND CONTROL LINKAGE STRUCTURE FOR LOADER BUCKETS

BACKGROUND OF THE INVENTION

The present invention relates to a loader vehicle and more specifically relates to lift arm guide linkages and self-levelling linkages for loader buckets.

It is known to connect loader lift arms to the frame of the loader vehicle through means of first and second guide links which operate to cause the lift arms to "reach out" at the same time they are raised in order to maintain a bucket carried by the arms forwardly of the vehicle frame throughout the entire range of vertical movement of the lift arms. U.S. Pat. No. 3,215,292, issued to Halls on Nov. 2, 1965, illustrates an example of such a vehicle; however, the reach effected by the guide links creates a stability problem since the center of gravity of the bucket continually moves outward from the supporting vehicle as the bucket raises.

It is also known to provide vehicles with self-levelling linkages which are used in conjunction with radial-type loader bucket lift arms to automatically maintain the bucket at a level attitude as the bucket is raised. Such levelling linkages are disclosed in U.S. Pat. No. 3,237,795, issued to Kromer on Mar. 1, 1966.

The broad idea of providing vehicles with lift arms mounted for being guided by two pairs of guide links that operate to "reach out" as the lift arms raise and for mounting a levelling linkage between one of the guide links and the bucket is also known as disclosed in U.S. Pat. No. 2,774,496, issued to Dorkins on Dec. 18, 1956. The Dorkins design operates similarly to Halls in that stability decreases as the bucket raises. Also, levelling of the bucket occurs only over the second half of the lift cycle.

SUMMARY OF THE INVENTION

According to the present invention, there is provided an improved combination of a bucket lift arm guide linkage and bucket self-levelling linkage.

A broad object of the invention is to provide a loader having a bucket supported such that it undergoes substantially vertical movement and such that it automatically maintains its attitude as it is raised and lowered.

A more specific object is to provide a loader having first and second pairs of guide links supporting the bucket lift arms and a self-levelling linkage connected between one of the pairs of guide links and the bucket, the guide links and levelling linkage cooperating to effect substantially vertical movement and to maintain bucket angularity as it is raised.

Yet another object of the invention is to provide a loader having lift arms supported by guide links, as set forth in the immediately preceding object, wherein the guide links cooperate to manipulate the lift arms to dispose the bucket at a forwardmost location when the bucket is at relatively low height and to dispose the bucket slightly rearward of its forwardmost position when the bucket is at its upper position.

These and other objects will become apparent from a reading of the following description, together with the appended drawings.

DESCRIPTION OF THE PREFERRED EMBODIMENT

Figure 1:
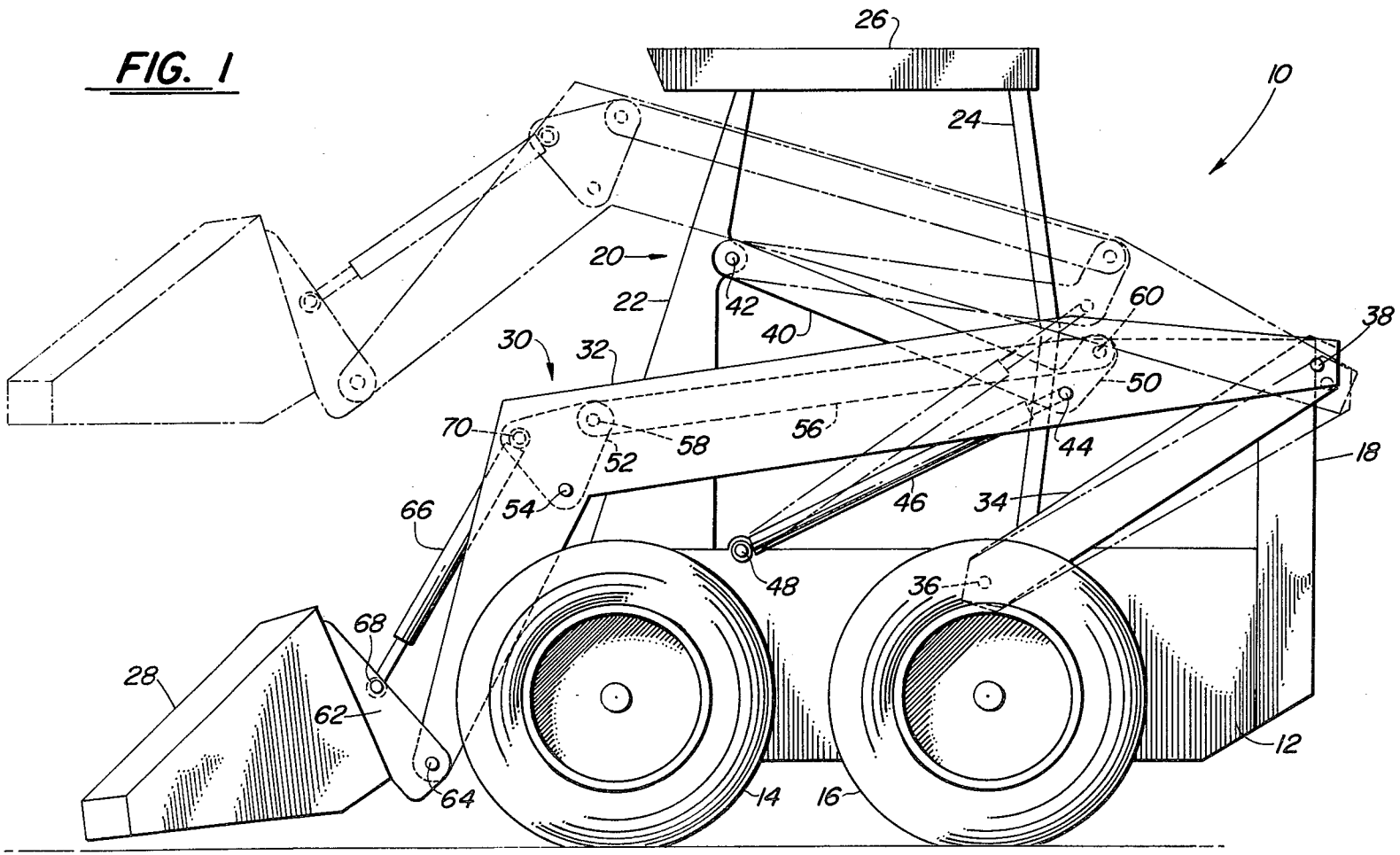
FIG. 1 is a side elevational view of a skid steer loader having a bucket supported and controlled in accordance with the present invention.

Preliminary to beginning the description to follow, it is to be noted that various parts are described as occurring in pairs while only one of each pair is illustrated in the drawings. It is to be understood that these unshown parts are constructed and mounted like their illustrated counterparts.

Referring to FIG. 1, therein is shown a skid steer loader 10 including a main frame 12 supported on front and rear pairs of drive wheels 14 and 16, respectively. Carried on the rear end portion of the frame 12 is an engine (not shown) enclosed within a compartment 18. An operator's station 20 is located on the frame 12 of the compartment 18 and includes an operator's cab having forward and rearward pairs of transversely spaced corner supports or posts 22 and 24, respectively. A cab roof or top 26 is connected to the upper ends of the supports 22 and 24.

A bucket 28 is supported for operation at the forward end of the loader 10 by a bucket support structure 30. The structure 30, as viewed in a lowered position illustrated in full lines in FIG. 1, includes a pair of generally L-shaped lift arms 32 located at opposite sides of the vehicle and including first leg sections extending forwardly from a location just rearwardly of an upper rear corner of the engine compartment 18 to a location just forwardly of respective lower portions of the forward cab supports 22. Second leg sections of the arms 32 form continuations of the forward ends of the first legs and extend downwardly and forwardly therefrom to locations just forwardly of the front wheels 14. A first pair of lift arm guide links 34 have their lower ends pivotally connected to the frame 12, as at 36, at respective locations spaced vertically above the axis of rotation of the rear wheels 16, and the links 34 have their upper ends pivotally connected, as at 38, to the rear ends of the arms 32. A second pair of lift arm guide links 40 have their forward ends pivotally connected, as at 42, to the forward cab supports 22 at respective locations approximately two-thirds of the distance from the bottoms to the tops of the supports. Rearward ends of the links 40 are respectively pivotally connected, as at 44, to the lift arms 32 at locations beside the rear cab supports 24. A pair of lift actuators 46 have their respective head ends pivotally connected, as at 48, to the frame 12 at respective locations just rearwardly of the lower ends of the supports 22, and their respective rod ends connected to the lift arms 32 by the connections 44.

The second pair of guide links 40 also serve as part of a combined bucket tilt and self-levelling linkage and for this purpose, include projections 50 which extend upwardly from the connections 44 at approximately 90° to respective lines extending through the connections 42 and 44. A pair of triangular bell cranks 52 have first vertices thereof respectively pivotally connected, as at 54, to the L-shaped arms 32 at the respective junctures of the first and second leg sections thereof. A pair of motion transfer links 56 have their forward ends pivotally connected, as at 58, to respective second vertices of the cranks 52 and have their rearward ends respectively connected, as at 60, to the projections 50. The bucket 28 has a pair of laterally spaced brackets 62 at its backside and the forward ends of the lift arm 32 are pivotally connected, as at 64, to the lower ends of the brackets 62. A pair of extensible and retractable bucket tilt cylinders 66 have their rod ends respectively pivotally connected, as at 68, to upper portions of the buckets 62 and have their head ends respectively pivotally connected, as at 70, to third vertices of the cranks 52.

Figure 2:
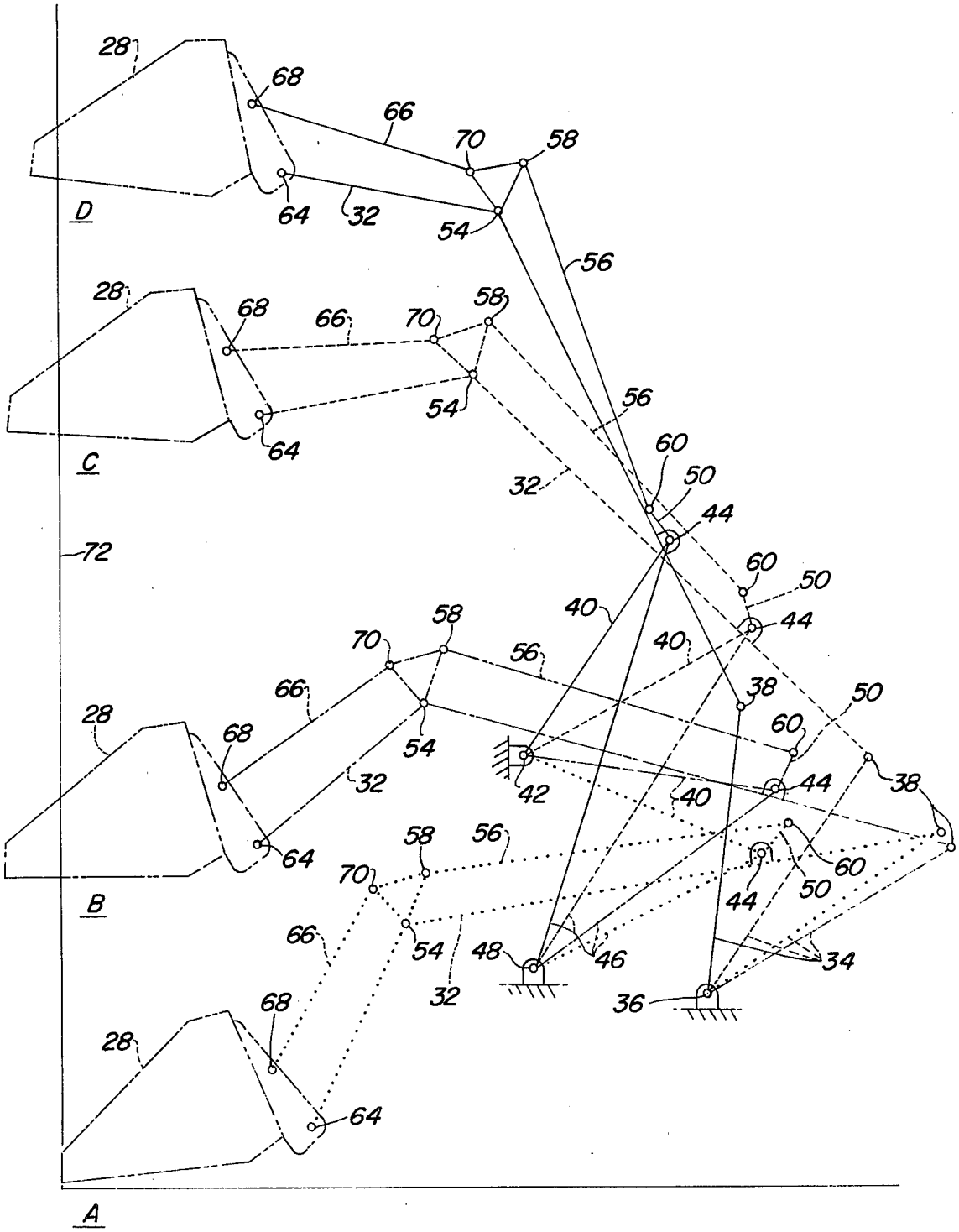
FIG. 2 is a schematic side elevational view showing the bucket, support arms and bucket tilt linkage in a family of positions illustrating the vertical lift and self-levelling characteristics of the loader.

Referring now to FIG. 2, therein is shown four different positions, A through D, which are assumed by the bucket 28 and the bucket support structure 30 as they move from a fully lowered condition (position A) to fully raised condition (position D). A vertical line 72 is drawn through a forward location 74 of the bucket 28 in its position A. From an inspection of FIG. 2, it can be seen that:

1. the bucket 28 is never rearwardly of the line 72 as it moves between its positions A and D,
2. the bucket 28 is at its greatest distance forwardly of the line 72 when in its B position and in this position, bucket 28 and the support structure 30 are below the level of the cab top 26,
3. the bucket 28 remains substantially at a constant attitude throughout its travel from position A to position D without any operation of the tilt actuators 66, and
4. the bucket 28 travels along a path substantially parallel to the line 72 as it moves between positions B and C and then moves toward the line 72 as it proceeds on to position D.

The significance of item 1 is that the loader bucket 28 is always far enough forward for being easily dumped into a container, regardless of the height of the sides of the latter.

The significance of items 2 and 4 is that the center of gravity of the bucket 28 is not shifted forwardly after raising past its position B and thus one factor which would otherwise contribute to increased instability as the bucket rises is eliminated. Below position B, maintaining vehicle stability is a relatively minor problem and above position C, the center of gravity of the bucket increasingly shifts toward the line 72, as the bucket rises toward position D, to thus diminish as a factor contributing to instability as the overall instability of the loader increases.

The significance of item 3 is that the bucket 28 is automatically maintained in an attitude conducive for retaining its load of material throughout the range of movement of the bucket from its A to its D position.

The operation of the combined structure for supporting the loader bucket for substantially vertical travel and for maintaining the bucket substantially level throughout its travel is as follows. Beginning with the loader in its A position, the bucket 28 may be raised by effecting extension of the pair of lift actuators 46. As the actuators 46 extend, the bucket will be moved upwardly and forwardly toward its B position. During this movement, the lift arms 32 are essentially pivoted about their rear ends inasmuch as the guide links 34 pivot only slightly clockwise about their lower connections 36. This causes the upward and forward movement of the bucket. At the same time, the second pair of guide links 40 swing counterclockwise about their connections 42 with the cab supports 22 and also undergo relative counterclockwise movement about their rear connections 44 with the lift arms 32. This latter movement of the guide links 40 results in the motion transfer links 56 being shifted forwardly to effect counterclockwise rotation of the bell cranks 52 about their connections 54 with the lift arms 32. When the cranks 52 pivot, they transfer movement to the tilt cylinders 66, resulting in the bucket 28 being pivoted counterclockwise about its connections 64 with the lift arms 32 so as to maintain the bucket in approximately the same level attitude that it occupied when in its position A.

As the pair of lift actuators 46 extend further so as to move the bucket 28 to its position C, the first pair of guide links will pivot counterclockwise about their lower pivot connections 36 and thus effect forward shifting of the lift arms 32 which are simultaneously guided upwardly by the second pair of links 40 with the forward end thereof rising faster than its rearward end at a rate which results in the forward movement of the lift arms 32 being nullified such as to effect vertical movement of the bucket 28. The second guide links 40 continue to pivot relative to the lift arms 32 about their rear connections 44 in a counterclockwise direction at a rate which results in the motion transfer links 56 being shifted forwardly to effect maintainance of the level condition of the bucket 28 through means of the crank 52 and actuators 66.

Movement of the loader bucket 28 from its position C to its position D occurs very much in the same manner described above for movement between positions B and C, except that the links 34 and 40 guide the lift arms 32 such as to cause the bucket 38 to move rearwardly instead of continuing vertically as it did when moving from position B to position C. This rearward movement of the bucket 38 aids in maintaining verticle stability as the bucket approaches its highest operating position.

We claim:

1. In a loader vehicle including a longitudinal main frame, a pair of loader arms respectively located at opposite sides of the frame, a loader bucket vertically pivotally mounted to respective forward ends of the pair of loader arms; a pair of hydraulically extensible and retractable tilt actuators respectively connected between the pair of arms and the bucket, first and second pairs of guide links respectively located with one of each pair on each side of the frame and having opposite end portions pivotally connected to the frame and to the pair of arms, and a pair of hydraulically extensible and retractable lift actuators respectively coupled between opposite sides of the frame and the pair of arms, and the first and second pairs of guide links being so dimensioned and located relative to each other and the pair of loader arms that as the latter are lifted, through operation of the lift actuators, they follow respective paths which maintain the bucket at least as far forward in any raised position as it is in a fully lowered position, the improvement comprising: said first pair of guide links each being defined by two leg portions joined to be generally L-shaped and with the respective ends of one of the two leg portions of the pair of guide links being pivotally connected to the frame; and a self-levelling linkage means, formed in part by the pair of tilt actuators, connected between the bucket and another of the two leg portions of the first pair of guide links for maintaining the bucket in substantially the same attitude throughout the movement of the lift arms.

2. The loader vehicle defined in claim 1 wherein the pair of lift actuators and the first pair of guide links are respectively pivotally connected to the pair of lift arms at the same location.

* * * * *